US010258085B2

(12) United States Patent
Xu

(10) Patent No.: US 10,258,085 B2
(45) Date of Patent: Apr. 16, 2019

(54) SYSTEM AND METHOD FOR VAPORIZING FLUIDS BY COMBUSTION

(71) Applicant: Westfield Limited (Ltd.), Hong Kong (CN)

(72) Inventor: Yongjie James Xu, Richmond, VA (US)

(73) Assignee: Westfield Limited (Ltd.), Hong Kong (CN)

( * ) Notice: Subject to any disclaimer, the term of this patent is extended or adjusted under 35 U.S.C. 154(b) by 584 days.

(21) Appl. No.: 14/712,143

(22) Filed: May 14, 2015

(65) Prior Publication Data

US 2016/0331028 A1 Nov. 17, 2016

(51) Int. Cl.
*A24F 47/00* (2006.01)

(52) U.S. Cl.
CPC ..... *A24F 47/006* (2013.01)

(58) Field of Classification Search
None
See application file for complete search history.

(56) References Cited

U.S. PATENT DOCUMENTS

| | | | | |
|---|---|---|---|---|
| 8,353,426 | B2 * | 1/2013 | Wold | B05B 11/025 222/1 |
| 2011/0094523 | A1 * | 4/2011 | Thorens | A24F 47/008 131/194 |
| 2014/0069424 | A1 * | 3/2014 | Poston | A24F 47/008 128/202.21 |
| 2014/0283855 | A1 * | 9/2014 | Hawes | A24F 47/008 131/328 |
| 2014/0366898 | A1 * | 12/2014 | Monsees | A24F 47/008 131/329 |
| 2017/0181468 | A1 * | 6/2017 | Bowen | A24D 1/14 |

OTHER PUBLICATIONS

Bowen et al. U.S. Appl. No. 61/994,787, filed May 16, 2014.*

* cited by examiner

*Primary Examiner* — Jacob T Minskey
*Assistant Examiner* — Baileigh Kate Darnell
(74) *Attorney, Agent, or Firm* — Nixon & Vanderhye P.C.

(57) ABSTRACT

A microvaporizer having a combustion heating device to vaporize stored fluids to produce vapors, including methods to supply fluid to the combustion heating device by pressure induced by a switch that releases pressure, a spring, or a negative pressure induced by a user's sucking action on a mouthpiece of the microvaporizer.

28 Claims, 8 Drawing Sheets

SYSTEM AND METHOD FOR VAPORIZING FLUIDS BY COMBUSTION

BACKGROUND OF THE INVENTION

The present invention relates to a handheld vaporizer or microvaporizer, particularly the vaporizer uses combustion to vaporize fluids to produce vapor.

The conventional handheld vaporizers or microvaporizers used as electronic cigarettes or electronic cigars are powered by electricity, through the forms of batteries or by plugging the vaporizer to an electrical outlet. To provide the vaporizer the ability of receiving, storing, and transforming electrical energy into heat energy for vaporization, the vaporizers are often bulky or heavy to carry. If using disposable battery, the vaporizers also tend to require frequent changes to the battery; or if the battery were rechargeable, it would require frequent charges to the battery.

BRIEF SUMMARY OF THE INVENTION

The present invention provides an alternative to the electrically powered handheld vaporizers or microvaporizers by using combustion, instead of electricity, to produce vapors.

Heating by combustion with flames or without flames may allow liquids to vaporizer more cleanly because heating by combustion having a more consistent heating temperature. Heating by combustion also allows heat to be provided within a short time, such as instantaneously as the heating device is engaged. This method also allows the heat source to be shut off instantaneously, and avoid overheating of the vaporizer components and over-vaporize the store fluids. Heaving the ability of turning on and shutting off the heat source instantaneously also provides an added safety feature to the vaporizer.

A microvaporizer using combustion to vaporizer fluids include an outer casing that forms a mouthpiece on a first end of the outer casing, and a vaporization section that includes a combustion heating device and a fluid transport device, and a storage chamber on a second end of the outer casing that includes a combustion fluid and a stored fluid for vaporization. The combustion heating device vaporizes fluid drawn from the stored fluid by the fluid transport device.

A method of vaporization using combustion includes storing a combustion fuel in a storage chamber of a vaporizer; storing a stored fluid for vaporization in a storage chamber of a vaporizer; supplying the combustion fuel to a combustion heating device inside a vaporization section of a vaporizer; delivering the stored fluid to the combustion heating device for vaporization using a fluid transport device; and vaporizing the stored fluid using combustion heating.

DETAILED DESCRIPTION OF THE INVENTION

The present invention provides a handheld vaporizer or microvaporizer that produces vapors through combustion. The vaporizer includes a combustion heating section and a storage section that may be reusable or disposable. The general concept of the present invention is to use a combustion device, such as a flame or flameless combustion heating device, to vaporize the desired fluid that may be provided to the heating device.

Figure 1:
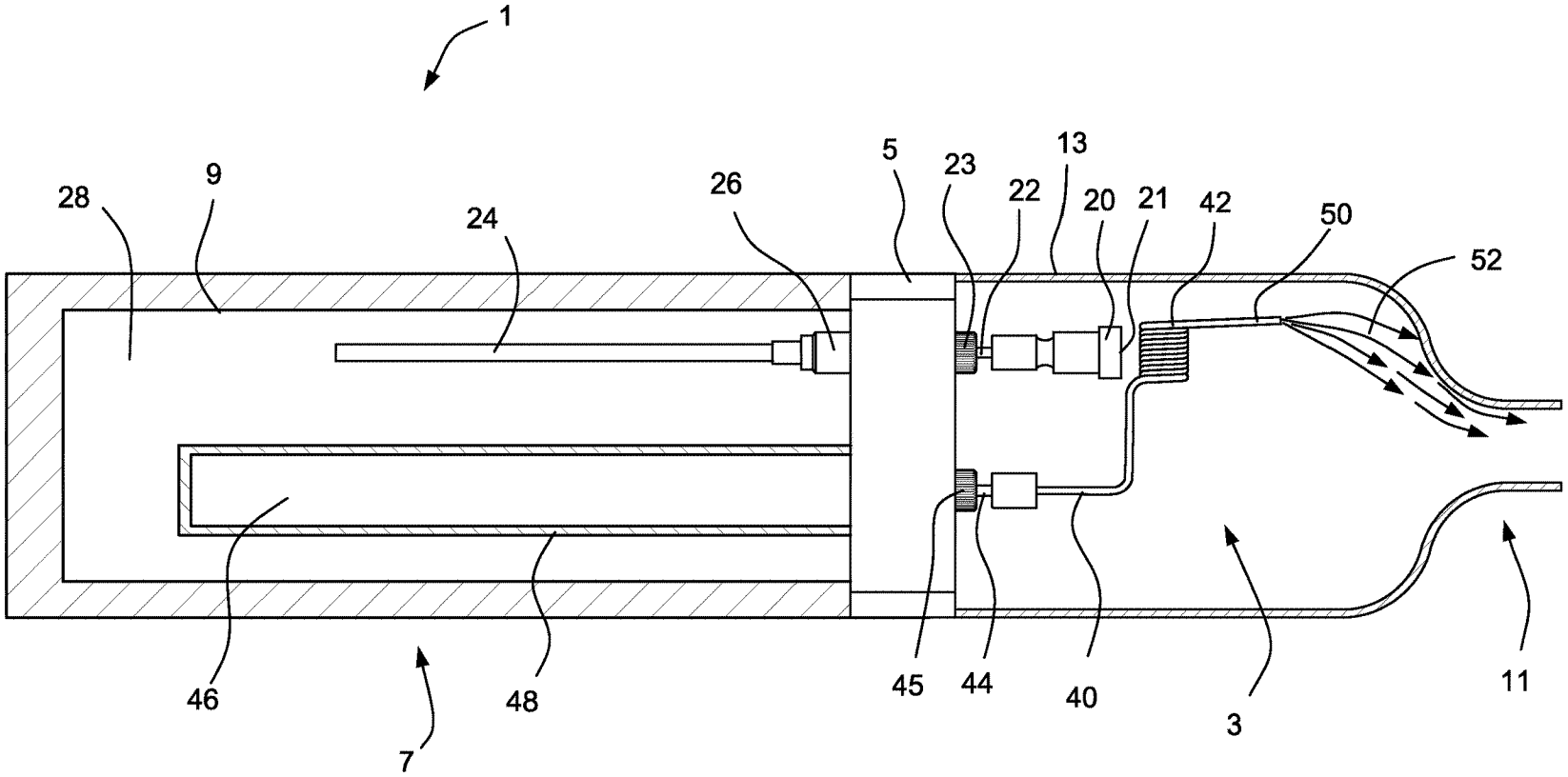
FIG. 1 illustrates an embodiment vaporizer that incorporates vaporization by a heating element using combustion.

FIG. 1 shows an embodiment of a combustion vaporizer 1 having a generally cylindrical shape with a mouthpiece. The combustion vaporizer 1 includes a vaporization section 3, a connector section 5, and a storage section 7. The combustion vaporizer 1 includes a mouthpiece 11 that is formed as a part of the exterior casing 13 that encases the vaporization section 3. The vaporization section 3 includes a combustion heating device 20 that can be a flame torch or a flameless heating device that is connected to and controlled by a valve 22.

The combustion heating device 20 draws combustion fuel 28 from a storage chamber 9 inside the storage section 7 of the vaporizer using a fluid transport device 40. The amount of combustion fuel 28 drawn from the storage chamber 9 through a valve 22. The valve 22 is regulated by a fuel control 23, which is supplied by fuel connector 26 that is embedded in the connector section 5 of the vaporizer 1, and the fuel 28 is transported to the combustion heat device 20 through tube 24 inside the storage chamber 9. The combustion heating device 20 may include a nozzle which releases the fuel as a fine spray, such as by atomizing the fuel. The fine spray is ignited, mixes with atmospheric oxygen and combusts. The combustion heats the coil 42 and vaporizes the fluid within the coil. The flame from combustion may or may not be applied directly to the coil 42 of the fluid transport conduit. For example, the flame may be confined to a chamber within the combustion heating device to heat a disc 21 or other structure that is adjacent and conforms to the coil. Heat from the disc or other structure heats the coil and the fluid flowing through the coil.

The amount of combustion, e.g., flame, may be restricted to avoid heating to excessive temperatures, such as above 350 degrees Fahrenheit, the vapor in the transport conduit 40. Similarly, the flame should not excessively heat the atmospheric air in the vaporization section 3 which is inhaled by the user. The combustion fuel 28 may be any combustible fuel that can be compressed or easy to transport, for example, ethanol, liquid butane and petroleum naptha.

A flameless heating device may also be used as the heating device. An example of a flameless heating device is a water-activated exothermic chemical heater. The heating device may be a chamber containing magnesium metal, iron and a salt. When water is added to the chamber, an exothermic chemical reaction occurs that generates heat. The fluid conduit 40 passes through the chamber. Heat generated in the chamber vaporizes fluid passing through the fluid conduit.

The stored fluid 46 is kept in a fluid compartment 48 located inside the storage section 7. The fluid compartment 48 may be separated from or enclosed in the combustion fuel 28 in the storage chamber 9. The fluid compartment 48 is operatively connected to the vaporization section 3 by the connector section 5. Fluid in the fluid component 48 is transported by a fluid transport device 40 with a valve 44, which is connected to and controlled by a fluid control 45 that is connected to the fluid compartment 48 through the connector section 5. The fluid transport device 40 may include a pipe, a string, a hollow coil 42, or any other suitable conduit to deliver fluid to the flame or heat generated by the combustion heating device 20. A coil 42 of the fluid transport device provides an extended passage that is in the heat generated by the combustion heating device.

The fluid control 45 can control the amount of fluid to be dispensed during a single use to the fluid transport device 40. The fluid transport device 40 may be connected to a vaporization component 42 that is located in close proximity to the combustion heating device 20, such that the combustion heating device 20 provides the heat to vaporize the fluid that is supplied to the vaporization component 42 by fluid transport device 40 and become vapor 52. Vapor 52 exits the vaporization section 3 through exit 50 that is supplied to a user through a mouthpiece 11.

The vaporization component 42 may be made as a part of the fluid transport device 40, such as a pipe that is in a in a closely looped form as shown in FIG. 1. The vaporization component 42 also may be a pipe that is in a different shape, such as an enlarged pipe, or in any other shape or type of conduit that may be suitable to form a vaporization chamber. The vaporization component 42 also may be a separate component from the fluid transport device 40, and is operatively connected to fluid transport device 40, such that stored fluid 46 can be supplied to the vaporization component 42. The vaporization component 42 provides a chamber or a surface for vaporization to occur. The stored fluid 46 may be heated and vaporized inside the chamber or on the surface of the vaporization component 42 by the combustion heating device 20.

Figure 2:
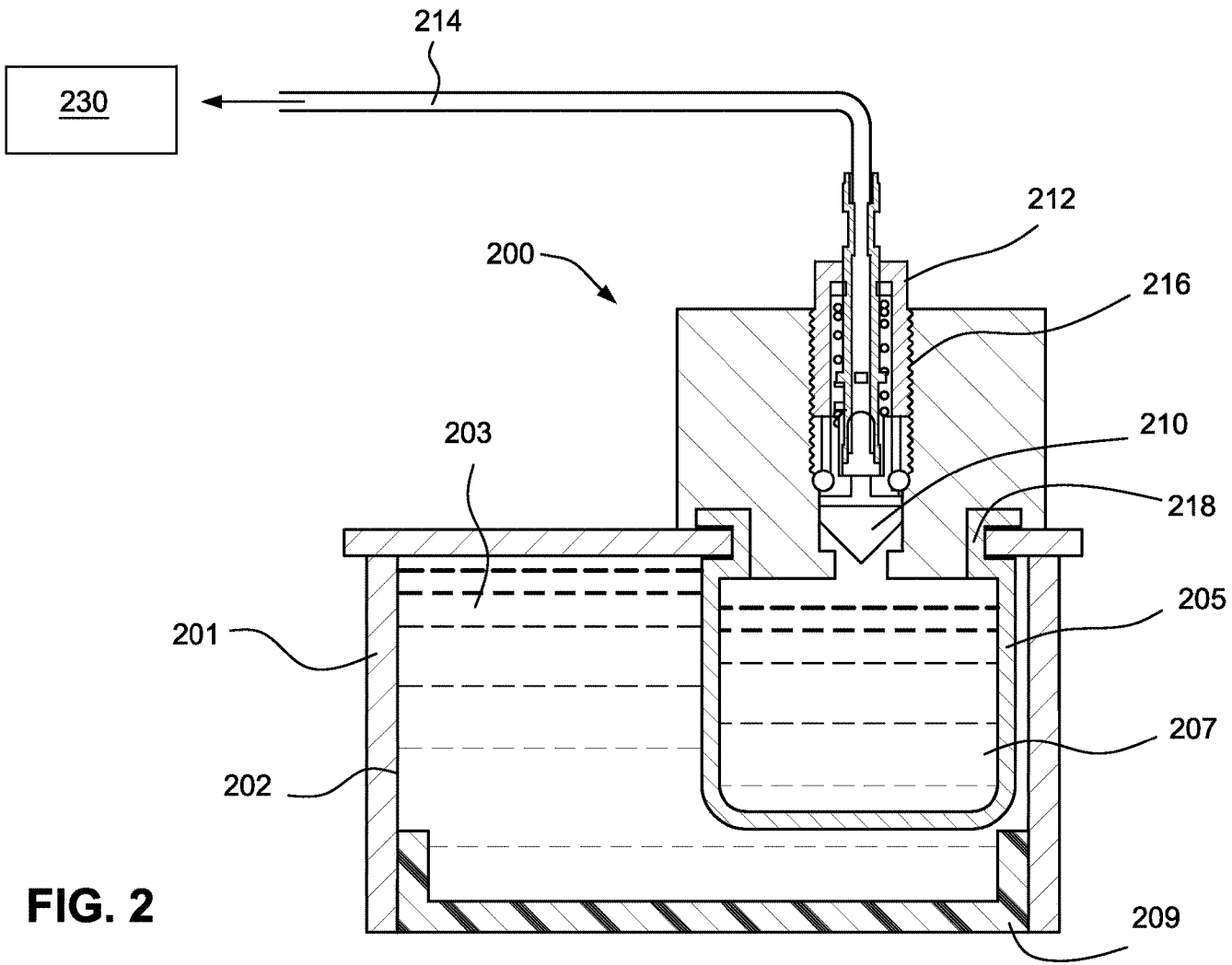
FIG. 2 illustrates a first method to supply fluid to a vaporization section by supplying pressure from a combustible fluid to a collapsible container that is filled with stored fluid.

FIGS. 2 to 6 show various exemplary methods of providing stored fluid to the vaporization component 42 may be applied to the vaporizer described and shown in FIG. 1. FIG. 2 depicts a first method to provide stored fluid 207 to a vaporization section 230 in the form of a cartridge 200. The cartridge 200 includes an outer casing 201 that defines a storage chamber 202 that is sealed from the atmosphere. The storage chamber 202 contains a combustible fluid 203 that is either in pressurized gas form or in liquid form, and a collapsible container 205 that is enclosed in the combustible fluid 203. The collapsible container 205 is sealed from the storage chamber 202.

The collapsible container 205 encases a stored fluid 207 that is operatively provided using a fluid transport device to a vaporization section 230 of a vaporizer. The stored fluid 207 is vaporized in the vaporization section 230 to provide the desired vapor to a user. The collapsible container 205 is fluidly connected to a fluid control 210 and a fluid valve 212, both of which are connected to a pipe 214 that may act as a fluid transport device, and supplies the stored fluid 207 to the vaporization section 230.

In this method, the stored fluid 207 is pushed through the valve 212 by applying pressure from the combustible fluid 203 onto the collapsible container 205. The pressurized combustible fluid 203 in storage chamber 202 provides a pressure that constantly surrounds the collapsible container 205, and the pressure from the combustible fluid 203 and the collapsible container 205 reach an equilibrium when the fluid valve 212 is not engaged. When the fluid valve 212 is engaged by a user, the balance of pressure inside the storage chamber 202 and the collapsible container 205 would be disrupted, during which the pressure from the combustible fluid 203 would induce the collapsible container 205 to contract, and the stored fluid 207 would be pushed from the collapsible container 205 through the fluid control 210 and fluid valve 212 into the pipe 214. The collapsible container 205 may be fixedly embedded into the outer casing 201, such that the collapsible container 205 and storage chamber 202 are engaged as one single disposable cartridge 200. Alternatively the collapsible container 205 may be releasable from the outer casing 201 to be replaced.

The cartridge 200 may be manufactured by forming an outer casing 201 having an engagement channel 216 that houses the fluid valve 212 and fluid control 210, and forming a storage chamber 202 in the outer casing 201 that includes a hook compartment 218 for the installation of a collapsible container 205. After the collapsible container 205 is installed, and the combustible fluid 203 is filled into the storage chamber 202, a flap 209 may be used to seal the storage chamber 202. The storage chamber 202 may also be reopened to the atmosphere by opening flap 209, such that the storage chamber 202 may be refilled, and the collapsible container 205 may be removed and replaced.

The engagement channel 216 may include threads that matched threads on fluid valve 212 to ensure a sealed engagement between the fluid valve 212 and the collapsible container 205.

Figure 3:
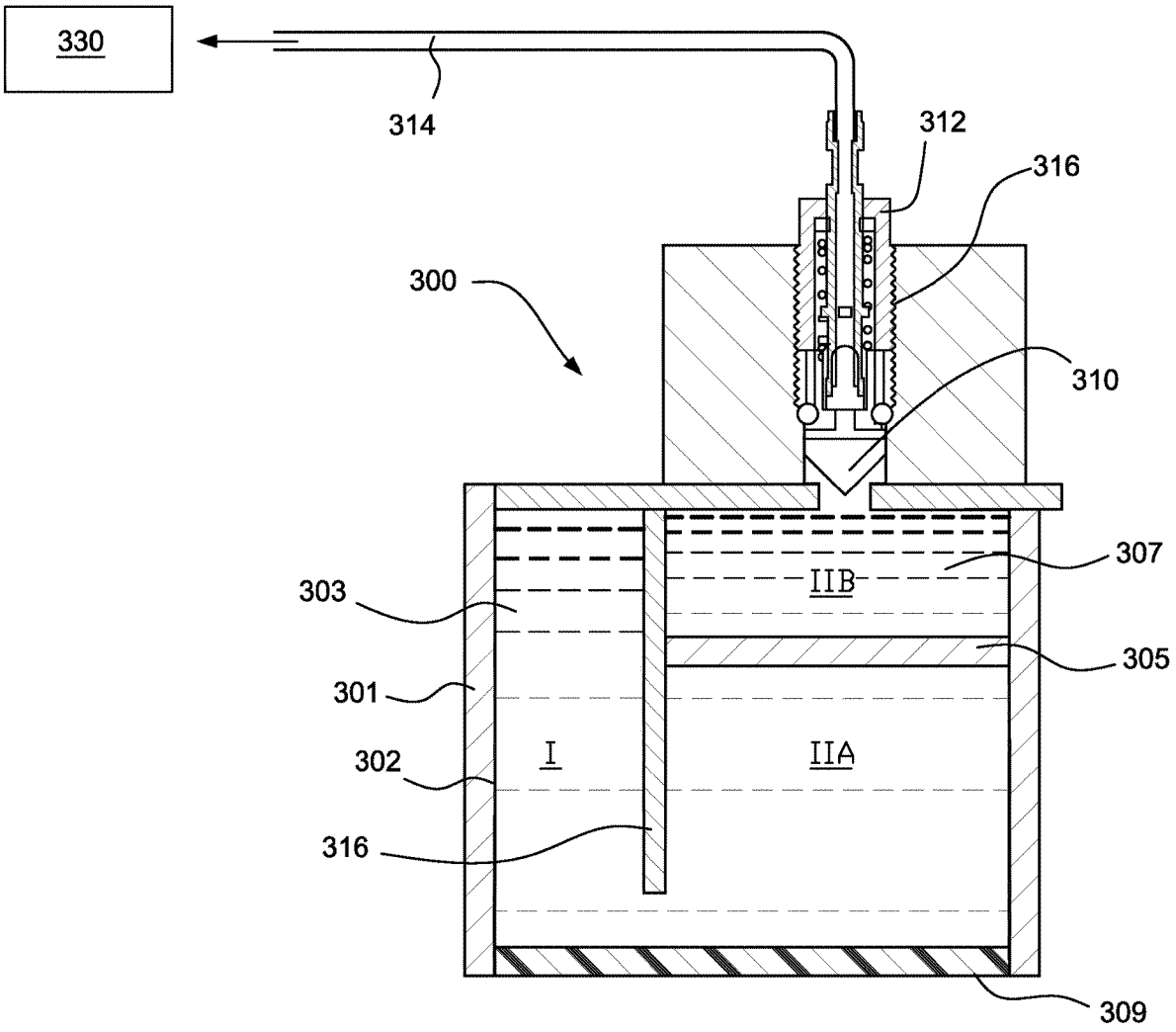
FIG. 3 illustrates a second method to supply fluid to a vaporization section by compartmenting a storage section in a vaporizer to store both stored fluid and combustible fluid on either side of a movable seal.

FIG. 3 depicts a second method to provide stored fluid 307 to the vaporization section 330 in the form of a cartridge 300. Cartridge 300 includes an outer casing 301 that defines a storage chamber 302. The storage chamber 302 is sealed from the atmosphere using a flap 309. The outer casing 301 also may include an engagement channel 316 that houses the fluid valve 312 and fluid control 310. Fluid valve 312 is connected to a fluid transport device, such as a pipe 314, which is operatively connected to a vaporization section 330 of the vaporizer.

The engagement channel 316 may include threads that matched threads on fluid valve 312 to ensure a sealed engagement between the fluid valve 312 and the storage chamber 302.

Using an inner divider 316, the storage chamber 302 is partially divided into two sections. The inner divider 316 is located such that the engagement channel 316 is fully located on the side of the compartment II of the inner divider 316, and is not fluidly connected to compartment I. Compartment II is further divided into compartment IIA and IIB by a movable seal 305 that seals compartment IIB from compartment IIA. The compartment IIB is defined by the movable seal 305, the outer casing 301 and the inner divider 316, and is fluidly connected to the fluid control 310 and fluid valve 312. Compartment I and compartment IIA are fluidly connected with each other. However, compartment IIB is not fluidly connected with compartments I and IIA. Compartment I and IIA stores combustible fluid 303, and compartment IIB contains stored fluid 307 for vaporization.

When the fluid valve 312 is not engaged by a user, the combustible fluid 303 asserts a pressure against the movable seal 305 that is returned by the stored fluid 307, such that an equilibrium of pressure is achieved on either side of the movable seal 305. When the fluid valve 312 is engaged by a user, pressure balance between compartment I and IIA and compartment IIB is disrupted by the release of pressure by the fluid valve 312, and the pressure from combustible fluid 303 pushes the movable seal towards the fluid valve 312, contracting the volume of compartment IIB to rebalance the equilibrium of pressure. When compartment IIB is contracted, the stored fluid 307 is simultaneously pushed to exit the valve 312 to be supplied to pipe 314 to be transported to the vaporization section 330.

The cartridge 300 may be used as a disposable or refillable cartridge. The cartridge 300 may be manufactured by forming the outer casing 301, filing compartment IIB with the stored fluid 307 then sealing the compartment IIB with the movable seal 305, filling the compartments I and IIA with combustible fluid 303, then sealing the storage chamber 302 from the atmosphere using the flap 309. The cartridge 300 may be also be refilled by opening flap 309 to access the compartments I, IIA and IIB in storage chamber 302.

Figure 4:
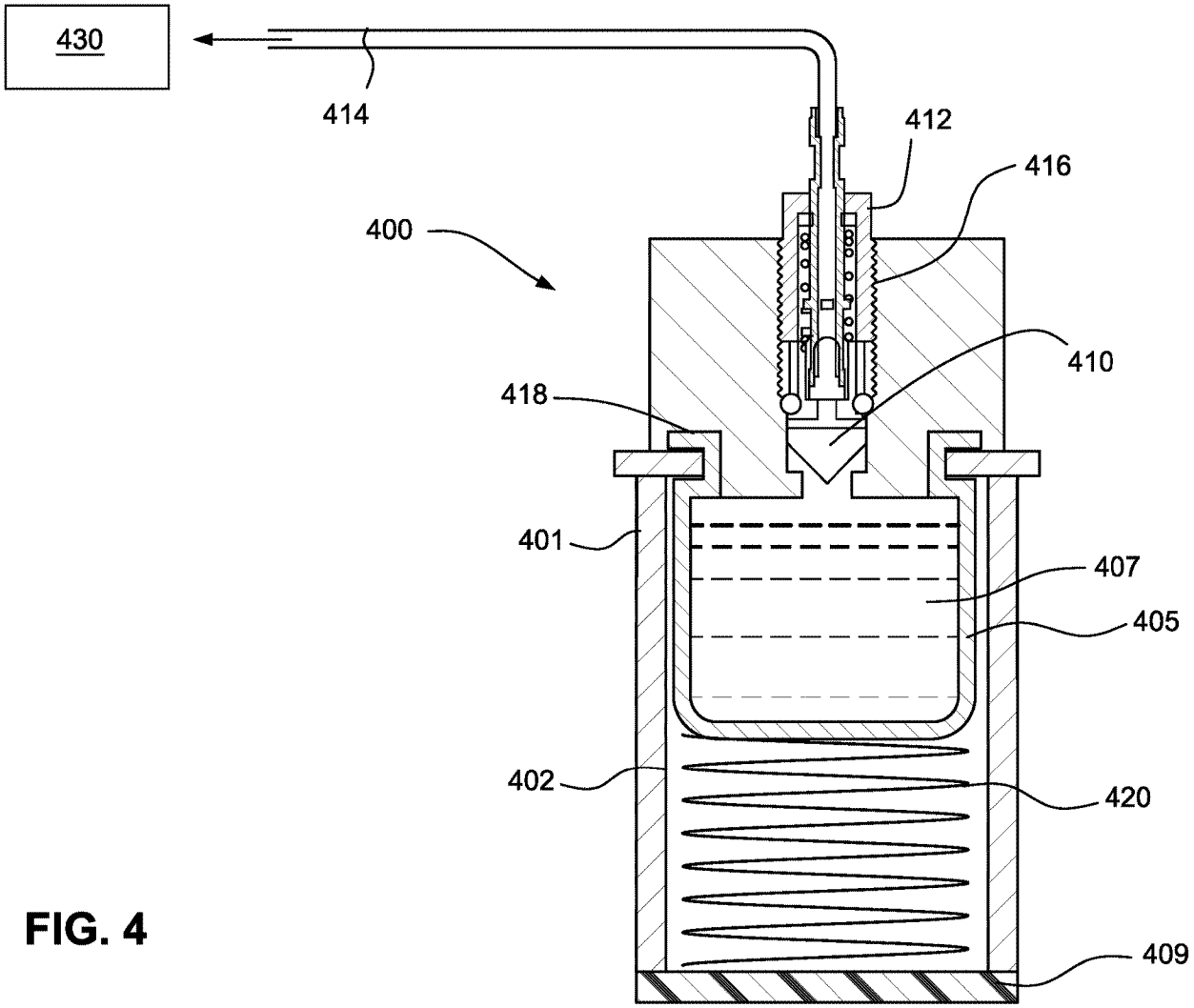
FIG. 4 illustrates a third method to supply fluid to a vaporization section by using a spring to provide pressure to a collapsible container that is filled with stored fluid.

FIG. 4 depicts a third method to provide stored fluid 407 to the vaporization section 430 in the form of a cartridge 400. The cartridge 400 includes an outer casing 401 that includes an engagement channel 416 for to house a fluid control 410 and fluid valve 412 that is operatively connected to the pipe 414.

The outer casing 401 also defines a storage chamber 402 that contains a spring 420 and a collapsible container 405. The storage chamber 402 is sealed by flap 409. The collapsible container 405 may be engaged in the outer casing 401 through a hook compartment 418, which seals the collapsible container 405 from the storage chamber 402.

The engagement channel 416 may include threads that matched threads on fluid valve 412 to ensure a sealed engagement between the fluid valve 412 and the collapsible container 405.

A spring 420 is used to push the stored liquid 407 to the fluid transport device, such as pipe 414. A first end of the spring 420 is rested upon flap 409, and a second end of the spring 420 is rested upon the collapsible container 405. The collapsible container 405 contains a stored fluid 407 for vaporization, such that when the fluid valve 412 is not engaged by the user, the pressure of the stored fluid 407 inside the collapsible container 405 is at an equilibrium with the spring 420. The spring 420 is configured such that a slight reduction in the air pressure in the vaporization section 13 causes the stored fluid to flow through the fluid valve. The slight reduction may be caused by a user inhaling while biting the mouthpiece and drawing air from the vaporization section 13.

When a user engages the fluid valve 412, the fluid valve 412 opens the collapsible container 405 to the atmosphere and reduces the pressure in the collapsible container 405. The reduction in pressure disrupts the pressure equilibrium between the collapsible container 405 and the spring 420, such that the spring provides more pressure to the collapsible container 405, and simultaneous the stored fluid 407 is pushed through the fluid valve to exit the collapsible container 405 into the pipe 414.

The cartridge 400 may be disposable, or may be refillable. The cartridge 400 is manufactured by forming a first of the outer casing 401 with an engagement channel 416 to engage the fluid valve 412 and fluid control 410, forming a storage chamber 402 that includes a hook portion 418 close to the engagement channel 416, such that the collapsible container 405 is embedded or sealed to the outer casing 401 to be fluidly connected only to the fluid control 410 and fluid valve 412, engaging a first end of a spring 420 to an end of the collapsible container 405 and engaging a second end of the spring 420 to a flap 409 that seals a second end of the outer casing 401 from the atmosphere. The cartridge 400 may be reopened at the flap 409, and the collapsible container 405 may be replaced or refilled with stored fluid 407.

Figure 5:
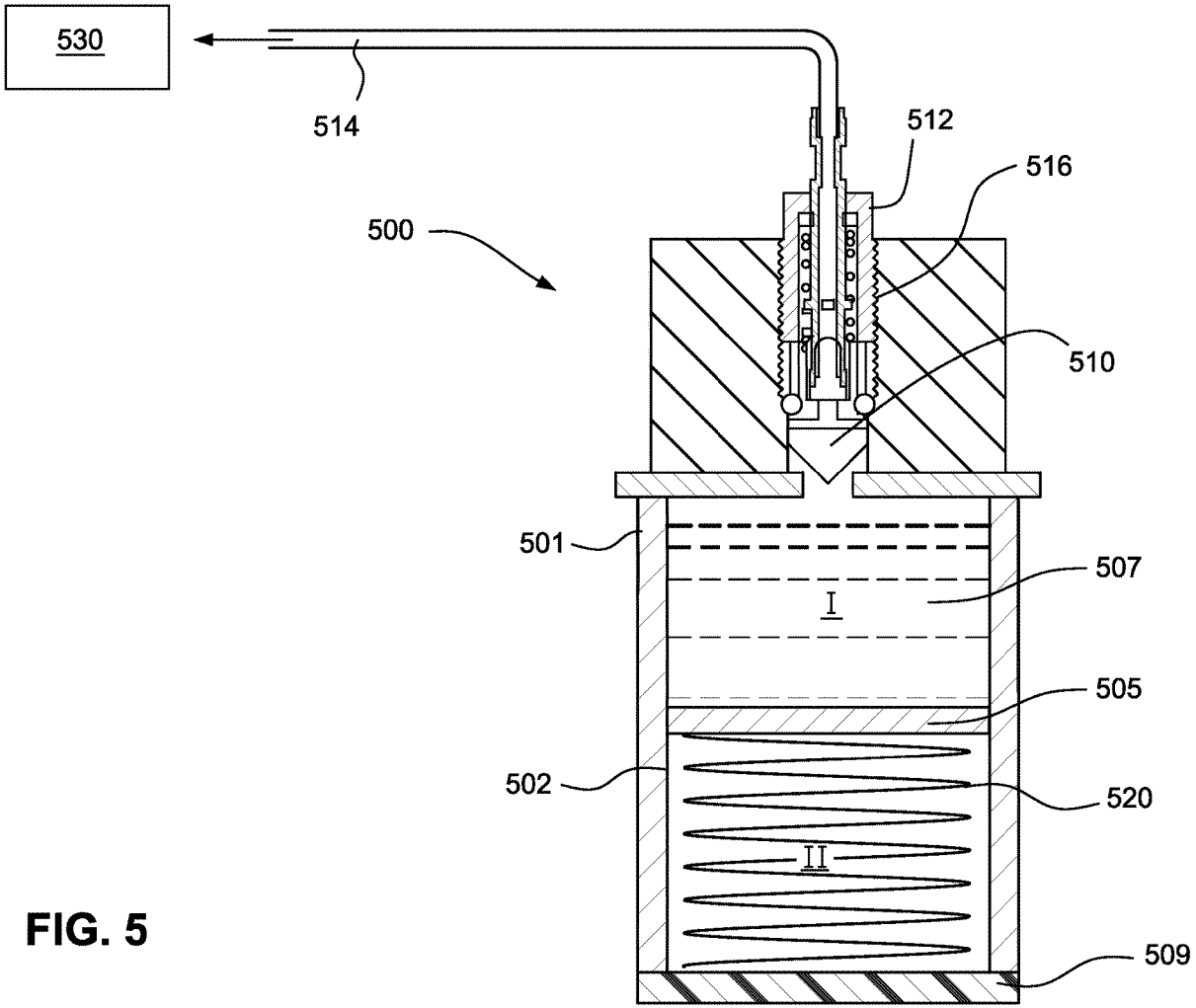
FIG. 5 illustrates a fourth method to supply fluid to a vaporization section by using a spring to provide pressure to a movable seal that sections off a stored fluid in a compartmentalized storage section of a vaporizer.

FIG. 5 shows a fourth method to provide stored fluid 507 to the vaporization section 530 in the form of a cartridge 500. The cartridge 500 is formed by an outer casing 501, which includes an engagement channel 516 that houses a fluid control 510 and a fluid valve 512, and defines a storage chamber 502 that is sealed by a flap 509. The fluid control 510 and fluid valve 512 are connected to a fluid transport device, such as a pipe 514, that supplies a stored fluid 507 in the cartridge 500 to a vaporization section 530 in a vaporizer.

The engagement channel 516 may include threads that matched threads on fluid valve 512 to ensure a sealed engagement between the fluid valve 512 and the storage chamber 502.

The storage chamber 502 is divided into two compartments, I and II, by a movable seal 505. Compartment I encases a stored fluid 507 that is fluidly connected to the fluid control 510 and fluid valve 512. Compartment I is sealed off from compartment II by the movable seal 505. Compartment II houses a spring 520 that has a first end engaged on the movable seal 505, and a second end supported by the flap 509. When the fluid valve 512 is not engaged by a user, the spring 520 provides pressure to the movable seal 505 such that the pressure of the stored fluid 507 pushing against the movable seal 505 in compartment I is at an equilibrium with the spring 520.

When a user engages the fluid valve 512, the pressure in compartment I is reduced, and the pressure equilibrium is disrupted. The spring 520 would push the movable seal 505 towards the stored fluid 507, reducing the volume of compartment I, and simultaneously push the stored fluid 507 to exit the fluid valve 512 into pipe 514 to be supplied to the vaporization section 530.

Cartridge 500 may be manufacture by forming the outer casing 501 with an engagement channel 516 to house a fluid control 510, adding a stored fluid 507 to the storage chamber 502 and sealing the storage chamber 502 to section the storage chamber into compartments I and II, adding a spring to compartment II, and sealing the storage chamber 502 with a flap 509. Cartridge 500 may be disposable, or may be refillable by reopening the flap 509, and refilling the stored fluid 507 in the storage chamber 502.

Figure 6:
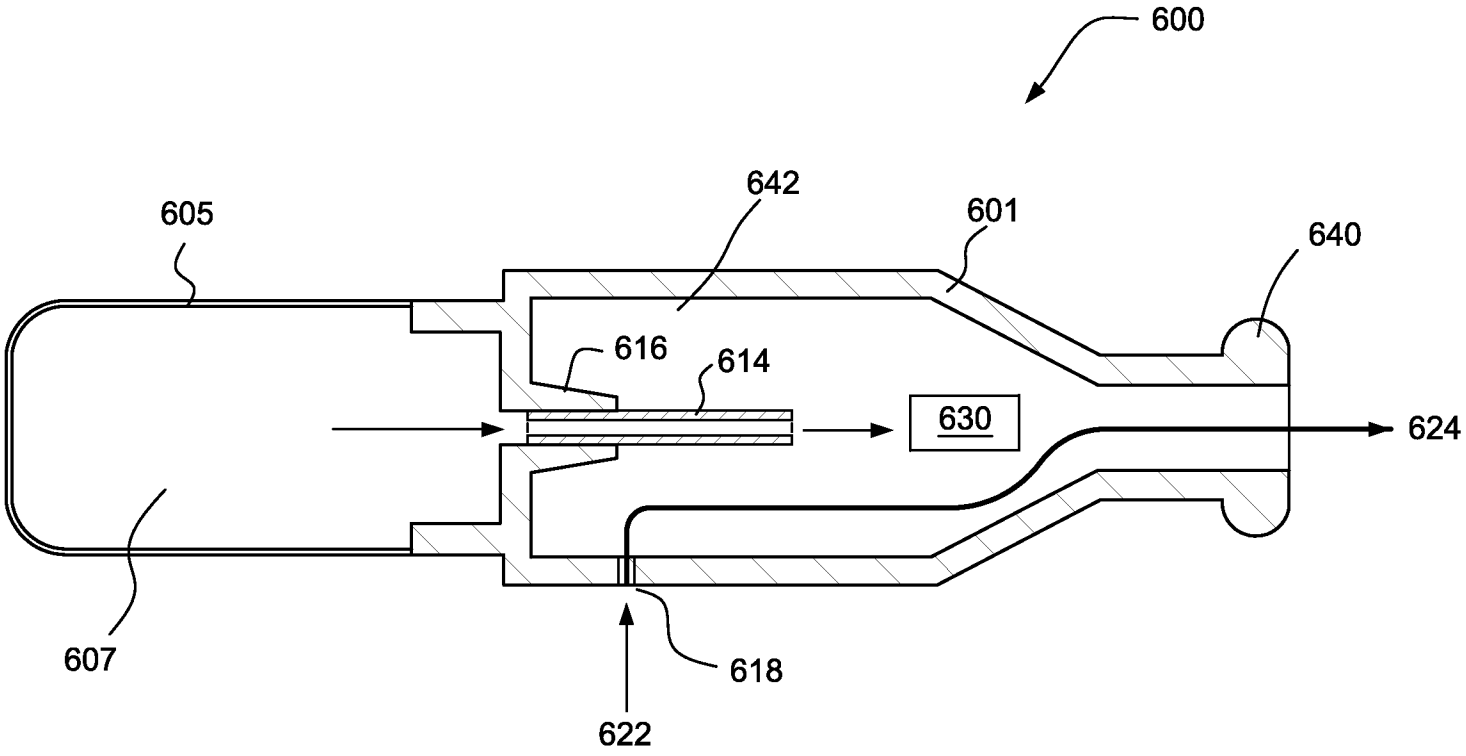
FIG. 6 illustrates a fifth method to supply fluid to a vaporization section by using a fluid transport device that includes a pipe having a diameter that is in a size that provides a droplet smaller than a natural droplet.

Alternatively, the stored liquid may be supplied to the vaporization section of a vaporizer using pressure change that is directly induced by a user of the vaporizer. FIG. 6 shows a fifth embodiment 600 that provides stored liquid 607 to a combustion heating device 630. The embodiment 600 includes an outer casing 601, which defines a vaporization chamber 642 that is connected to a mouthpiece 640 on one end of the vaporization chamber 642, which is open to the atmosphere. The outer casing 601 includes an air hole 618 on a second end of the vaporization chamber 642 that allows air 622 to be drawn into the vaporization chamber 642.

The outer casing 601 also forms a support 616 that engages with a fluid transport device 614 which supplies stored fluid 607 to the vaporization section 642 to be vaporized by the combustion heating device 630. The fluid transport device 614 fluidly communicates between the vaporization section 642 and a collapsible container 605 that contains stored fluid 607. The collapsible container 605 may be attached to the outer casing 601 such that the collapsible container 605 is permanently sealed to the section of the outer casing 601 that includes the support 616 and fluid transport device 614. The collapsible container 605 may also be detachable from the outer casing 601 such that the collapsible container 605 may be replaced or refilled with stored fluid 607.

The collapsible container 605 may be fluidly connected to the vaporization section 642 through the fluid transport device 614. The fluid transport device 614 may be, for example, a pipe that has a diameter that supplies fluid to the combustion heating device 630 in a size that is smaller than a natural droplet of fluid. The size of the diameter of the pipe would be such that the fluid in the pipe would not be drawn out of the pipe in atmospheric pressure. The stored fluid 607 in the collapsible container 605 may be supplied to the fluid transport device 614 by a capillary action of the stored fluid 607 from one end of the fluid transport device 614 that is in fluid communication with the stored fluid 607. When the vaporizer is not engaged by a user, pressure between the stored fluid 607 in the collapsible container 605 would be at an equilibrium with the stored fluid 607 present in the fluid transport device 614.

When a user engages the mouthpiece 640 and applies a sucking pressure to draw air 624 into the mouthpiece 640, the user induces a negative pressure lower than the atmospheric pressure in the vaporization section 642 that would draw the stored fluid 607 to exit the fluid transport device 614 to be supplied to the combustion heating device 630. The amount of stored fluid 607 drawn to the combustion heating device 630 directly relates to the amount of sucking pressure applied by a user.

The negative pressure in the vaporization section 642 would be quickly balanced back to atmospheric pressure using air flow 622 that would be drawn through the air hole 618 by the negative pressure induced by the user simultaneously when the stored fluid 607 is drawn from the liquid transportation device 614. As the pressure in the vaporization section 642 is returned to atmospheric pressure, the drawing action of the stored liquid 607 would also stop. The collapsible container 605 may contract as the volume of the stored liquid 607 is reduced.

The embodiment 600 may be a single manufactured cartridge that is fully disposable, or may be partially disposable by replacing or refilling the collapsible container 605 with new stored fluid 607.

Figure 7:
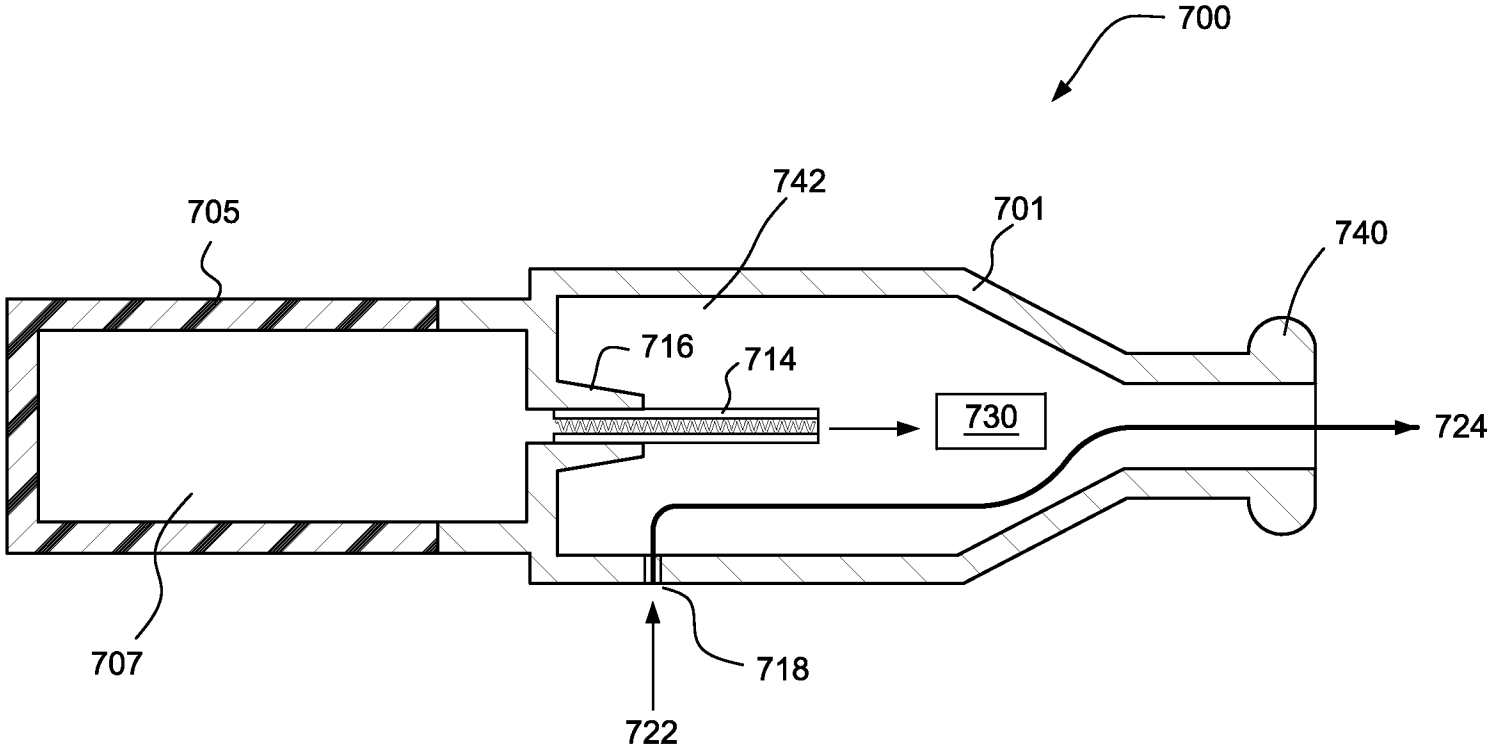
FIG. 7 illustrates a sixth method to supply fluid to a vaporization section by using a wicking device that supplies fluid via a capillary action of the liquid on the wicking device.

FIG. 7 shows a sixth embodiment that provides stored fluid 707 to a combustion heating device 730. The embodiment 700 includes an outer casing 701, which defines a vaporization chamber 742 that is connected to a mouthpiece 740 on one end of the vaporization chamber 742, which is open to the atmosphere. The outer casing 701 includes an air hole 718 on a second end of the vaporization chamber 742 that allows air 722 to be drawn into the vaporization chamber 742.

The outer casing 701 also forms a support 716 that engages with a fluid transport device, such as a wick 714, which supplies stored fluid 707 to the vaporization section 742 to be vaporized by the combustion heating device 730. The wick 714 fluidly communicates between the vaporization section 742 and a container 705 that contains stored fluid 707. The container 705 may be attached to the outer casing 701 such that the container 705 is permanently sealed to the section of the outer casing 701 that includes the support 716 and wick 714. The container 705 may also be detachable from the outer casing 701 such that the container 705 may be replaced or refilled with stored fluid 707.

The container 705 may be fluidly connected to the vaporization section 742 through the wick 714. The stored fluid 707 in the container 705 may be supplied to the wick 714 by a capillary action of the stored fluid 707 from a first end of the wick 714 that is in fluid communication with the stored fluid 707, towards a second end of the wick 714 that is optimally connected to or close in proximity with the combustion heating device 730.

When the vaporizer is not engaged by a user, pressure between the stored fluid 707 in the collapsible container 705 would be at an equilibrium with the stored fluid 714 present in the fluid transport device 714. When a user engages the mouthpiece 740 and applies a sucking pressure to drawn air 724 into the mouthpiece 740, the user induces a negative pressure lower than the atmospheric pressure in the vaporization section 742 that would draw the stored fluid 707 onto the wick 714 to be supplied to the combustion heating device 730. The amount of stored fluid 707 drawn to the combustion heating device 730 directly relates to the amount of sucking pressure applied by a user.

The negative pressure in the vaporization section 742 would be quickly balanced back to atmospheric pressure using air flow 722 that would be drawn through the air hole 718 by the negative pressure induced by the user simultaneously when the stored fluid 707 is drawn from the wick 714. As the pressure in the vaporization section 742 is returned to atmospheric pressure, the drawing action of the stored liquid 707 would also stop.

The embodiment 700 may be a single manufactured cartridge that is fully disposable, or may be partially disposable by replacing or refilling the container 705 with new stored fluid 707.

Figure 8:
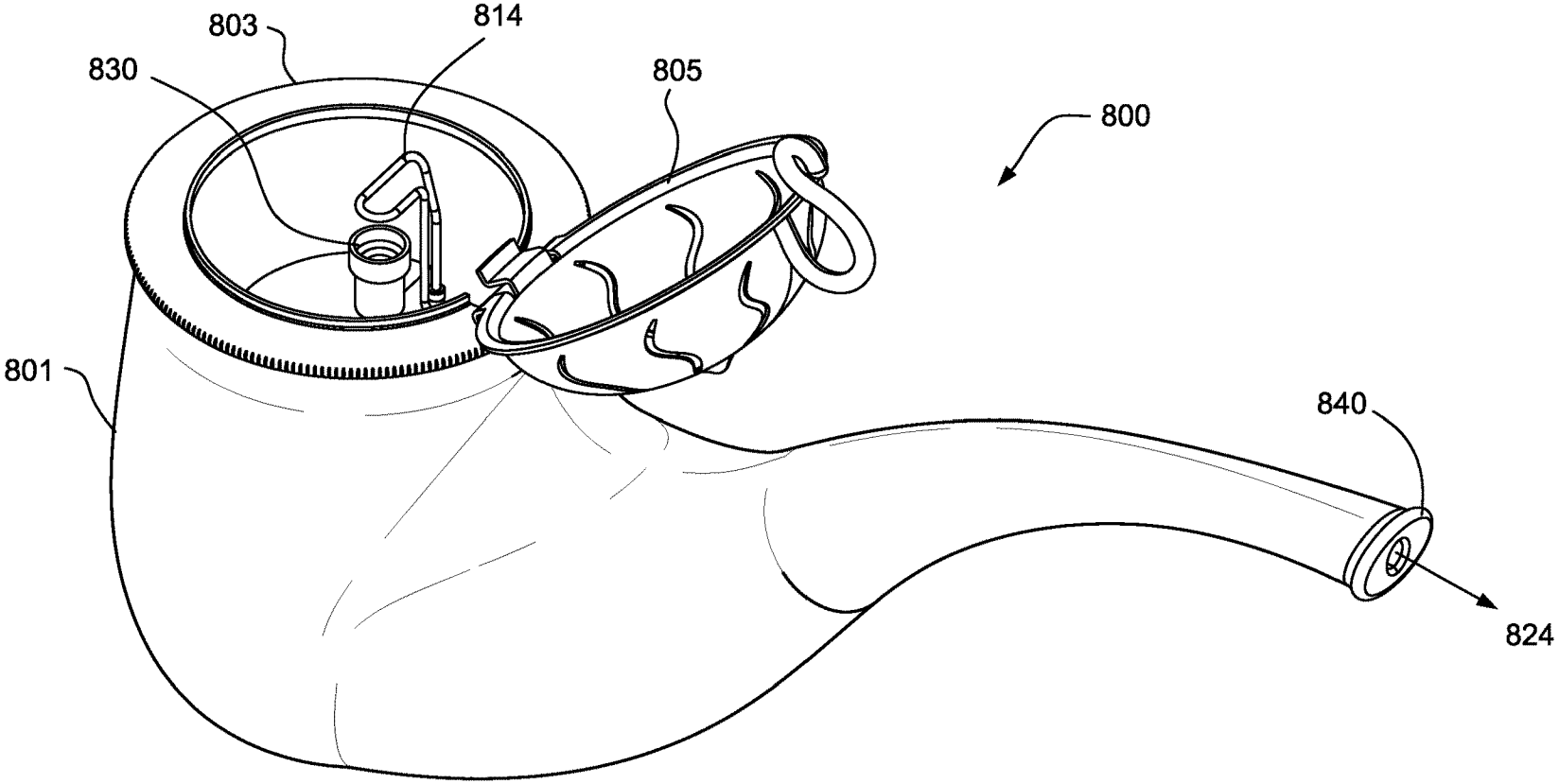
FIG. 8 illustrates an alternative embodiment vaporizer in the shape of a pipe that incorporates vaporization by a heating element using combustion.

The use of vaporization through combustion heating can be applied to another embodiment vaporizer in the shape of a pipe as shown in FIG. 8. The pipe 800 is formed by an outer casing 801 that includes a mouthpiece 840, using which a user would draw vaporized fluid 824 from the pipe 800. The pipe 800 also includes a top opening 803 that may be covered by a lid 805. Combustion fluid and stored liquid for vaporization are encased inside the pipe 800, and as can be seen through the top opening 803, the stored liquid may be transported to a combustion heating device 830 using a fluid transport device 814 in the shape of a pipe that allows fluid to be vaporized inside the pipe, and returns the vaporized fluid 824 to exit towards the mouthpiece 840. The fluid transportation device 814 may be any suitable forms of device that supplies stored fluid towards the combustion heating device. The method of fluid transportation to be applied to the pipe 800 may be any of the above described methods shown in FIGS. 2 to 7.

Advantages of the present invention includes reducing manufacturing costs and material costs by eliminating the need for a battery or battery casing, increasing product versatility and portability by reducing the weight of the vaporizer, improving safety of the product by reducing toxic vapors during use, and improving the controllability of the vaporizer by providing fast heat delivery and shut-off.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A microvaporizer comprising:

an outer casing that forms a mouthpiece on a first end of the outer casing;

a vaporization chamber that includes a combustion heating device;

a fluid transport device within the vaporization chamber, the fluid transport device including a hollow tubular conduit defining an internal flow passage with an inlet configured to receive a liquid for vaporization and an outlet to discharge vapor into the mouthpiece, wherein a heating section of the hollow tubular conduit is adjacent to the combustion heating device, and a storage chamber in the outer casing, wherein the storage chamber is configured to store separately the combustion fluid and the liquid for vaporization, wherein the inlet of the hollow tubular conduit is arranged to receive the liquid for vaporization from the storage chamber and wherein a combustion fluid outlet to the storage chamber is connected to an inlet to the combustion heating device;

wherein the combustion heating device is configured to combust the combustion fluid and apply heat from the combustion fluid and apply heat from the combustion to vaporize the liquid for vaporization as the liquid flows through the heating section of the hollow tubular conduit.

2. The microvaporizer of claim 1, wherein the fluid transport device is a pipe.

3. The microvaporizer of claim 1, wherein the storage chamber includes first chamber configured to store the combustion fluid and a collapsible container configured to store the liquid for vaporization, and the collapsible container is sealed from the first chamber.

4. The microvaporizer of claim 3, wherein the liquid for vaporization is pushed into the fluid transport device by pressure applied to the collapsible container by the combustion fluid in the first chamber.

5. The microvaporizer of claim 1, wherein the liquid for vaporization is stored in a collapsible container portion of the storage chamber, and the liquid for vaporization is pushed into the fluid transport device by a spring applied to the collapsible container.

6. The microvaporizer of claim 1, wherein the storage chamber is divided into compartments, and includes a movable seal that separates the combustion fuel from the liquid for vaporization.

7. The microvaporizer of claim 6, wherein the movable seal stays in place due to an equilibrium of pressure exerted on a first side of the movable seal by the combustion fuel and on a second side of the movable seal by the liquid for vaporization.

8. The microvaporizer of claim 7, wherein the pressure from the combustion fuel causes the movable seal to contract a volume of the liquid for vaporization compartment due to a negative pressure introduced into the liquid for vaporization compartment.

9. The microvaporizer of claim 6, wherein the movable seal stays in place due to an equilibrium of pressure exerted on a first side of the movable seal by the liquid for vaporization, and on a second side of the movable seal by a spring.

10. The microvaporizer of claim 9, wherein the pressure of the spring causes the movable seal to contract the volume of the liquid for vaporization compartment due to a negative pressure introduced into the liquid for vaporization compartment.

11. The microvaporizer of claim 1, wherein the fluid transport device is a pipe that has a diameter configured to supply a predetermined a mount of liquid for vaporization to the combustion heating device.

12. The microvaporizer of claim 11, further comprising an air hole on a second end of the vaporization chamber.

13. The microvaporizer of claim 12, wherein fluid is drawn by the fluid transport device due to a negative pressure caused by a user applying a sucking pressure to the mouthpiece.

14. The microvaporizer of claim 13, wherein an amount of fluid drawn by the fluid transport device is directly related to the amount of sucking pressure applied by a user to the mouthpiece.

15. The microvaporizer of claim 12, wherein fluid drawn stops when pressure inside the vaporization section is returned to atmospheric pressure due to air drawn simultaneously by the user through the air hole.

16. The microvaporizer of claim 1, wherein the fluid transport device includes a wick and the combustion heating device is confined in a chamber having an element heated by combustion, wherein the element of the combustion heating device transfers heat from the combustion to vaporize liquid transported via the wick.

17. The microvaporizer of claim 1, wherein the microvaporizer is in the shape of a pipe.

18. The microvaporizer of claim 1, wherein the heating section of the hollow tubular conduit is a coiled tubular conduit.

19. A method to vaporize fluids in a microvaporizer, comprising:

storing a combustion fuel in a storage chamber of a vaporizer;

storing a stored fluid for vaporization in a storage chamber of a vaporizer;

supplying the combustion fuel to a combustion heating device inside a vaporization section of a vaporizer, and combusting the combustion fuel at the combustion heating device to generate heat energy;

delivering the stored fluid to the combustion heating device for vaporization through an internal passage of a hollow-tubular conduit of a fluid transport device; and applying the heat energy from the combustion at the combustion heating device to the hollow tubular conduit;

vaporizing the stored fluid by passing the stored fluid through a portion of the internal passage heated by the heat energy applied to the hollow tubular conduit, and discharging the vaporized stored fluid from the internal passage into a mouthpiece portion of the microvaporizer.

20. The method of claim 19, wherein the stored fluid is stored in a collapsible container.

21. The method of claim 20, wherein the stored fluid is supplied to the fluid transport device by a pressure applied by the combustion fuel on the collapsible container in the storage chamber.

22. The method of claim 20, wherein the stored fluid is supplied to the fluid transport device by a pressure applied by a spring on a collapsible container in the storage chamber.

23. The method of claim 19, wherein the storage chamber is compartmentalized, and the stored fluid is sealed from the combustion fuel by a movable seal.

24. The method of claim 23, wherein the stored fluid is delivered to the fluid transport device by a pressure applied on the movable seal from the combustion fuel.

25. The method of claim 23, wherein the stored fluid is delivered to the fluid transport device by a pressure applied on the movable seal from a spring in the storage chamber.

26. The microvaporizer of claim 19, wherein the hollow tubular conduit includes a section which is a coil tubular conduit aligned with the combustion heating device.

27. A microvaporizer comprising:

a casing;

a storage chamber within the casing, wherein the storage chamber is configured to store a combustion fuel under pressure;

a fluid compartment within the storage chamber wherein the fluid compartment is configured to store a vaporization liquid and the fluid compartment is collapsible under the pressure of the combustion fuel;

a combustion heating device housed in a vaporization chamber of the casing, wherein the combustion heating device includes an inlet configured to receive combustion fluid from the storage chamber and the combustion heating device is configured to combust the combustion fluid to generate heat energy; and a fluid transport device in the vaporization chamber and including a hollow tubular conduit including an internal passage having an inlet configured to receive the vaporization liquid from the fluid compartment and an outlet aligned with a vapor outlet of the casing, wherein the hollow tubular conduit includes a heating section adjacent the combustion heating device and configured to conduct heat energy from the combustion of the combustion fluid into the internal passage, wherein as the vaporization liquid flows through the internal passage, the vaporization liquid is heated and vaporized by the heat energy from the combustion and the vaporized vaporization liquid flows as vapor from the outlet of the internal passage, through the vaporization chamber and through the vapor outlet of the casing.

28. The microvaporizer of claim 27, wherein the heating section of the hollow tubular conduit is a helically coiled tubular conduit.

* * * * *